United States Patent [19]

Montagna

[11] 4,005,006

[45] Jan. 25, 1977

[54] COMBINATION RESIDUE HYDRODESULFURIZATION AND THERMAL CRACKING PROCESS

[75] Inventor: Angelo A. Montagna, Monroeville, Pa.

[73] Assignee: Gulf Research & Development Company, Pittsburgh, Pa.

[22] Filed: July 18, 1975

[21] Appl. No.: 597,398

[52] U.S. Cl. ..... 208/89

[51] Int. Cl.[2] ..... C10G 23/00

[58] Field of Search ..... 208/89, 126, 127

[56] References Cited

UNITED STATES PATENTS

| | | | |
|---|---|---|---|
| 2,846,373 | 8/1958 | Schutte | 208/126 |
| 2,852,440 | 9/1958 | Smith et al. | 208/126 |
| 3,019,272 | 1/1962 | Steinhofer et al. | 208/127 |
| 3,254,020 | 5/1966 | Frayer et al. | 208/89 |
| 3,324,028 | 6/1967 | Benther et al. | 208/89 |
| 3,598,720 | 8/1971 | Stolfa | 208/89 |
| 3,617,502 | 11/1971 | Stolfa et al. | 208/89 |

*Primary Examiner*—D. Horwitz
*Assistant Examiner*—James W. Hellwege

[57] ABSTRACT

A process comprising passing a residual oil through a plurality of hydrodesulfurization stages in series to produce a relatively low sulfur hydrodesulfurizer residual oil effluent. A portion of desulfurized oil flowing between stages is passed through a thermal cracking zone containing a packed bed of inert solids to produce middle distillates and a cracked residual oil which is relatively high in sulfur but which contains less than 7 weight percent pentane insolubles. Because of its low aromaticity, the relatively high sulfur cracked residual oil is compatible for blending with the relatively low sulfur hydrodesulfurizer residual oil effluent.

9 Claims, 2 Drawing Figures

FIGURE I

Figure 1:
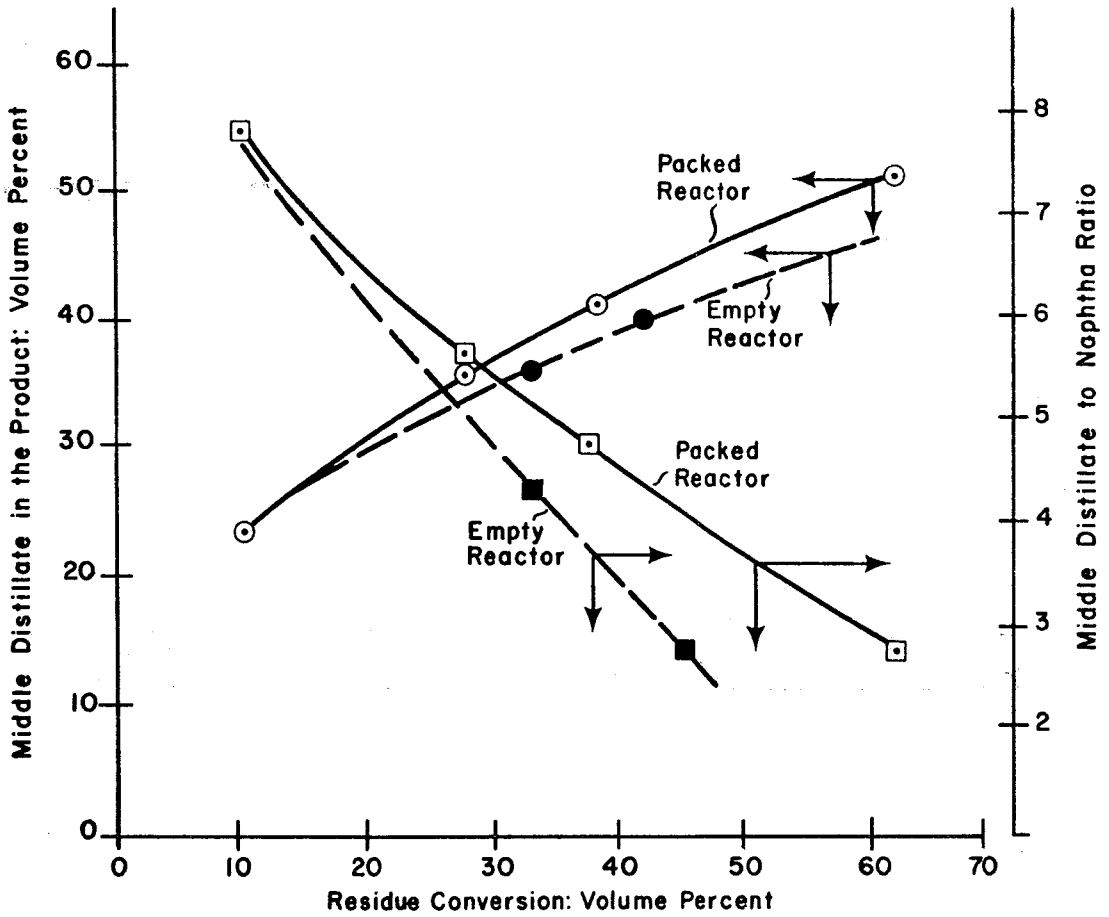

RELATIONSHIP BETWEEN RESIDUE CONVERSION AND (1) Middle Distillate
(2) Middle Distillate/Naphtha Ratio

COMBINATION RESIDUE HYDRODESULFURIZATION AND THERMAL CRACKING PROCESS

This invention relates to the thermal treatment of residual oils to upgrade these oils to middle distillates boiling in the furnace oil, diesel fuel and jet fuel range, in preference to the naphtha range.

Residual oil hydrodesulfurization processes are capable of reducing the sulfur content of residual oils with relatively little hydrocracking. U.S. Pat. No. 3,562,800 shows, in FIG. 4, that in catalytic hydrodesulfurization of residual oil hydrocracking does not become significant until reaction temperatures of about 790° F. (421° C.), or above, are reached. It is advantageous to depress hydrocracking during catalytic residual oil hydrodesulfurization because catalytic hydrocracking reactions generally result in some production of naphtha. The production of naphtha via hydrocracking consumes hydrogen for a wasteful purpose because naphtha is easily and economically produced in the absence of added hydrogen via fluid catalytic cracking (FCC). FCC is commercially performed in a riser at a residence time of less than five seconds at a temperature of 900° to 1,100° F. (482° to 593° C.) with a zeolite catalyst without added hydrogen. The absence of added hydrogen in an FCC process has two advantages. First, in FCC the naphtha is produced without incurring the expense of hydrogen consumption and, secondly, in FCC the olefins and aromatics in the naphtha product necessarily remain unsaturated due to the absence of hydrogen and, since olefins and aromatics are high octane number components, FCC naphtha generally exhibits higher research and motor octane values than does hydrocracked naphtha.

This invention is advantageously directed towards thermal upgrading of the effluent from residual oil hydrodesulfurization processes in which sulfur removal occurs with little or no production of naphtha, i.e. in which the conversion of 650° F.+ (343° C.+) residual oil to naphtha is generally less than 10 or 20 percent, and preferably is less than 1 to 5 percent. The process of this invention is also directed towards the upgrading of residual oils which have not been desulfurized, such as either atmospheric tower bottoms or vacuum tower bottoms. In accordance with the present invention, either a non-hydrodesulfurized residual oil or a residual oil hydrodesulfurizer effluent, with or without prior flashing of middle distillates and lighter material, or a blend of the two, is treated in a thermal cracking or visbreaking stage with or without added hydrogen to convert a portion of the hydrodesulfurized or non-hydrodesulfurized residual oil to middle distillates boiling in the range 350° to 650° F. (177° to 343° C.), with only a relatively small concomitant production of 350° F.− (177° C.−) naphtha and lighter material. When the visbreaking operation is performed in the presence of added hydrogen production of naphtha is especially undesirable for the same reasons stated above that naphtha production is undesirable in the earlier hydrodesulfurization stage. The visbreaking process is performed with very little production of coke so that liquid recovery from the process can be 97 to 100 weight percent, or more, with any weight gain being due to addition of hydrogen. Also, the asphaltene content in the visbreaker 650° F.+ (343° C.+) residue of this invention can be not more than 4 or 5 weight percent higher than in the 650° F.+ (343° C.+) feed oil. Therefore, the process yields a low aromatic residue which is compatible for blending with lower sulfur residue fractions from other processes.

The visbreaking process of the present invention provides significant advantages regardless of whether the visbreaker feed oil is hydrodesulfurized. If the feed oil is not hydrodesulfurized, since thermal desulfurization occurs during visbreaking in proportion to the extent of conversion, the relatively high conversion occurring in the visbreaking process of this invention will provide correspondingly high levels of desulfurization. This desulfurization is aided by, but does not require, the presence of added hydrogen. If a hydrodesulfurized feed oil is employed, even though the feed oil is thereby rendered less refractory the present process provides the advantage of maintaining a high selectivity to middle distillates in preference to overcracking to naphtha. It is shown below that in a visbreaking process of the prior art which employed a coil for visbreaking a hydrodesulfurized feed oil, the gasoline yield was more than twice as great as the middle distillate yield, and was greater than the gasoline yield obtained by visbreaking a non-desulfurized oil.

The visbreaking operation of this invention can be performed at a temperature of 750° to 1,000° F. (399° to 538° C.), generally, and at a temperature of 790° to 950° F. (421° to 510° C.), preferably. The pressure can be 100 to 5,000 psi (7 to 350 kg/cm$^2$), generally, and 100 to 2,500 psi (7 to 175 kg/cm$^2$), preferably. The process can be performed without added hydrogen. If hydrogen is fed to the process, the hydrogen flow rate can be 500 to 10,000 SCF per barrel (8.0 to 178 SCM/100L), generally, and 500 to 2,500 SCF per barrel (8.0 to 44.5 SCM/100L), preferably, and the aforementioned pressure ranges can be hydrogen pressure. The oil residence time in the visbreaker can be 0.0014 to 5 hours, generally, or 0.3 to 3 hours, preferably.

As stated, the feed oil to the visbreaker can be non-hydrodesulfurized. If hydrodesulfurization of the visbreaker feed oil is desired, known residual oil hydrodesulfurization conditions, such as are disclosed in U.S. Pat. No. 3,562,800, can be employed. Suitable hydrodesulfurization catalysts include at least one Group VI metal and at least one Group VIII metal disposed on a non-cracking support, such as alumina. Other non-cracking supports include silica stabilized, alumina, magnesia alumina, and silica magnesia. The hydrodesulfurization catalysts advantageously have a small particle size, such as a diameter between 1/20 and 1/40 inch (0.127 to 0.064 cm.) Catalytic hydrogenation metal combinations can comprise cobalt-molybdenum, nickel-tungsten, nickel-molybedenum, nickel-cobalt-molybdenum, etc. Titanium can be included as a promoter metal, and a nickel-titanium-molybdenum-alumina catalyst is highly advantageous.

The prior hydrodesulfurization operation can occur in one, two or three stages in series. Suitable operating conditions for each hyrodesulfurization stage include a temperature in the range from about 690° to 790° F. (366° to about 421° C.), which is below subsequent visbreaking temperatures. The liquid space velocity can be in the range from about 0.1 to about 10, preferably less than about 5.0, and more preferably from about 0.2 to 3 volumes of feed oil per volume of catalyst per hour. The hydrogen feed rate can range from about 500 to about 10,000 SCF per barrel (8.0 to 178 SCM/100L) of the feed oil, preferably it can range from about 1,000 to 8,000 SCF per barrel (17.8 to 142 SCM/100L) and more preferably it can range from about 2,000 to about 6,000 SCF per barrel (35.6 to 106.8 SCM/100L). The hydrogen partial pressure can be in the range from about 50 to about 5,000 psi (3.5 to 350 kg/cm²), and preferably is 500 to about 3,500 psi (35 to 245 kg/cm²), and more preferably is between 1,000 and 2,500 psi (70 to 175 kg/cm²). The hydrogen pressure in the prior hydrodesulfurization operation is generally higher than in the visbreaking operation, but it can be the same as or lower than the hydrogen pressure in the visbreaking operation.

Because the residual oil visbreaking process of this invention converts residual oil to middle distillates with restriction of aftercracking of middle distillates to naphtha, the process has high utility where it is desired to enhance a product mix of furnace oil, diesel oil and jet fuel and to depress production of gasoline.

In accordance with the present invention, it has been discovered that visbreaking of residual oils can be accomplished with an increased yield of middle distillates by performing the visbreaking operation in the presence of a fixed or packed (non-fluid) bed of catalytically inert and nonporous solids, as compared to an unpacked reactor. It has been further discovered that the improved middle distillate yield is particularly realized when the residual oil, with or without hydrogen, is passed upwardly through the packed bed of substantially stationary solids while considerably inferior results are obtained in downflow operation. That there is an advantage due to upflow operation is particularly surprising since upflow of a liquid reactant produces a flooded bed in which there is a continuous liquid phase whereas downflow passage of oil through a packed reactor results in trickle flow of oil so that when hydrogen is added with the oil the oil trickles through a continuous hydrogen phase. Trickle flow of oil through a continuous hydrogen phase provides superior contact of oil, hydrogen and solid and is therefore generally more advantageous than an upflow operation in catalytic processes wherein concomitant contact of liquid oil, hydrogen and solid is required. Therefore, it would be expected that where a hydrovisbreaking process is significantly benefited by the presence of a packed inert solid within the reactor, a downflow operation would be preferable to upflow operation. However, data presented below show that significantly superior results are obtained by employing upflow operation in combination with a packed bed in the hydrovisbreaking process of this invention.

Although it is commonly observed in conventional visbreaking processes that any increase in middle distillate yield is accompanied by a disproportionate increase in naphtha yield due to aftercracking, it is shown below that the enhanced production of middle distillates in accordance with the packed bed process of this invention is achieved with little or no increase in the product ratio of middle distillates to naphtha. In fact, it has been found that the packed bed hydrovisbreaking process of this invention not only produces an enhanced yield of middle distillates, as compared to a packing-free hydrovisbreaking process, but it can do so with an enhanced product ratio of middle distillates to naphtha.

In contrast to the process of the present invention, U.S. Pat. No. 3,324,028 relates to a prior art visbreaking process in a coil reactor. The patent indicates a middle distillate coil visbreaker yield of only 6.8 percent when employing a hydrodesulfurized feed oil, and further indicates a considerably greater yield of gasoline than middle distillate. On the other hand, the data presented below show that considerably greater yields of middle distillates are obtained according to the present process than in a coil reactor, while maintaining a product ratio of middle distillates to gasoline greater than one, even when the visbreaker feed is hydrodesulfurized. Therefore, the present process advantageously provides the combination of high middle distillates yield and high resistance against overcracking to naphtha. The data presented below show that the yield advantages of this invention as compared to a coil reactor are obtained no matter whether upflow or downflow operation through the packed bed are employed, although superior results are obtained with upflow operation.

The advantages of a packed bed visbreaking system are illustrated by the following tests. In the following tests, the 350° F.+ (177° C.+) effluent from single stage hydrodesulfurization of a 650° F.+ (343° C.+) 4 weight percent sulfur Kuwait petroleum residue is passed to a hydrovisbreaker. The hydrodesulfurized oil charged to the visbreaker in all the tests reported below has the characteristics of a 350° F.+ (177° C.+) flashed hydrodesulfurizer effluent shown in Table 1, with the exception of only Test 8 of Example 7, which employed a non-desulfurized feed oil.

TABLE 1

HYDRODESULFURIZER EFFLUENT CHARGED TO HYDROVISBREAKER

| Distillation | | Naphtha | Middle Distillate | Residue |
|---|---|---|---|---|
| Boiling Range: ° F. | — | (over point) OP-350 (OP-177° C.) | 350–650 (177–343° C.) | 650+ (343° C.+) |
| Volume Percent | 100 | 0 | 18.60 | 81.13 |
| Weight Percent | 100 | 0 | 17.26 | 82.58 |
| Inspection | | | | |
| Gravity: ° API | 22.4 | — | 34.3 | 19.7 |
| Specific Gravity, 60°/60° F. (15.6°/15.6° C.) | 0.9194 | — | 0.8534 | 0.9358 |
| Sulfur, Wt. percent | — | — | 0.22 | 1.14 |
| Aromatics | — | — | 39.5 | — |
| Olefins | — | — | 1.0 | — |
| Saturates | — | — | 59.5 | — |
| Nitrogen, Wt. percent | — | — | 0.031 | — |
| Carbon, Wt. percent | — | — | 86.56 | — |
| Hydrogen, Wt. percent | — | — | 13.01 | — |
| Nickel, ppm | — | — | — | 5.4 |
| Vanadium, ppm | — | — | — | 11.0 |
| Pentane Insolubles (asphaltenes) | | | | |

TABLE 1-continued

| Distillation | HYDRODESULFURIZER EFFLUENT CHARGED TO HYDROVISBREAKER | | | |
|---|---|---|---|---|
| | | Naphtha | Middle Distillate | Residue |
| Wt. percent | — | — | — | 3.36 |
| Carbon Residue Rams, Wt. percent | — | — | — | 5.42 |
| Viscosity, SUV Sec. 100° F. (38° C.) | 652 | — | — | — |
| 210° F. (99° C.) | 69 | — | — | — |

Separate portions of the hydrodesulfurized oil of Table 1 were hydrovisbroken, one portion in a packed bed of inert non-catalytic, non-porous alundum balls (alundum comprises fused anhydrous aluminum oxide), and another portion in an empty reactor devoid of any solids. The packed bed hydrovisbreaking test was performed in upflow operation in a reactor packed with alundum balls at the conditions detailed in Example 1. The hydrovisbreaking operation in the empty reactor ws performed in upflow operation at the conditions detailed in Example 2. Examples 1 and 2 show that except for the packing the conditions of the two tests were about the same. The results of these tests are shown in Table 2.

breaker product includes the quantity of middle distillate present in the visbreaker feed which was produced in the hydrodesulfurizer, but no naphtha was produced in the hydrodesulfurizer. The packed reactor produced the increased middle distillate yield with a middle distillate to naphtha product ratio of 2.8, as compared to a ratio of 2.7 in the product of the empty reactor. Therefore, the packed reactor produced a much higher middle distillate yield, while advantageously maintaining at least the product ratio of middle distillate to naphtha obtained with a lower total conversion in the unpacked reactor. This indicates that the packed reactor advantageously does not increase overcracking, as compared to an empty reactor, even though it considerably in-

TABLE 2

| | Packed Reactor | | | | Empty Reactor | | | |
|---|---|---|---|---|---|---|---|---|
| | OP-350° F. (OP-177° C.) | 350–650° F. (177–343° C.) | 650° F.+ (343° C.+) | Middle Distillate to Naphta Ratio | OP-350° F. (OP-177° C.) | 350–650° F. (177–343° C.) | 650° F.+ (343° C.+) | Midddle Distillate to Naphta Ratio |
| Product Yield: vol. % | 18.08 | 50.24 | 31.42 | 2.8 | 14.75 | 40.11 | 44.66 | 5.7 |
| conversion of 650° F. + (343° C.+) | | | | | | | | |
| Residue in Feed: Vol. % | — | — | 61.3 | | — | — | 44.95 | |
| Gravity: ° API | 63.5 | 36.6 | 12.6 | | 61.0 | 36.7 | 17.8 | |
| Sulfur: Wt. % | (515 ppm) | 0.34 | 1.67 | | (522 ppm) | 0.33 | — | |
| Aromatics | 10.5 | 34.0 | — | | 8.5 | 39 | — | |
| Olefins | 15.5 | 6.0 | — | | 15.5 | 1.5 | — | |
| Saturates | 74.0 | 60.0 | — | | 76.0 | 59.5 | — | |
| Nitrogen: Wt. % | <0.005 | 0.036 | — | | — | — | — | |
| Pentane Insolubles: Wt. % | % | — | — | 6.49 | | — | — | — |
| Carbon Resid. Rams | — | — | 10.20 | | — | — | — | |

Table 2 shows that in the packed reactor residual oil conversion was 61.3 volume percent, as compared to only 44.95 volume percent for the unpacked reactor. The packed reactor product contained 50.24 volume percent of middle distillate, as compared to only 40.11 volume percent for the unpacked reactor. In all tests, the reported quantity of middle distillate in the viscreases middle distillate yield.

Examples 1 through 6 are presented to further demonstrate the visbreaking process of this invention and include tests made both within and outside the conditions of the present invention to illustrate the superior results obtainable within the conditions of the visbreaking process of this invention. The results of Examples 1 through 6 are presented in Table 3.

TABLE 3

VISBREAKING OF HYDRODESULFURIZED RESIDUAL OIL

| | Hydrovisbreaker Feed Oil | | EXAMPLE 1 Hydrovisbreaker Product from Packed Bed, Upflow Operation-799° F. (426° C.), 1,000 psig (70 kg/cm²) and 2.31 hours | | | EXAMPLE 2 Hydrovisbreaker Product from Empty Reactor, Upflow Operation-795° F. (424° C.) 1,000 psig (70 kg/cm²) and 2.41 hours | | |
|---|---|---|---|---|---|---|---|---|
| Cut Temperature: ° F. | 350+ (177° C.+) | 650+ (343° C.+) | OP-350 (OP-177° C.) | 350–650 (177–343° C.) | 650+ (343° C.+) | OP-350 (OP-177° C.) | 350–650 (343° C.+) | 650+ |
| Volume Percent | 100 | 81.13 | 18.08 | 50.24 | 31.42 | 14.75 | 40.11 | 44.66 |
| Weight Percent | 100 | 82.58 | 15.16 | 48.88 | 35.64 | 12.41 | 38.63 | 48.46 |
| Conversion of 650° F.+ (343° C.+) Feed: Vol. % | — | — | — | — | 61.3 | — | — | 44.95 |
| Liquid Recovery: Wt. % | — | — | — | — | 100.1 | — | — | 97.6 |

TABLE 3-continued

VISBREAKING OF HYDRODESULFURIZED RESIDUAL OIL

| | | | | | | | | |
|---|---|---|---|---|---|---|---|---|
| Inspection | | | | | | | | |
| Gravity: ° API | 22.4 | 19.7 | 63.5 | 36.6 | 12.6 | 61.0 | 36.7 | 17.8 |
| Specific Gravity: 60°/60° F. (15.6/15.6° C.) | 0.9194 | 0.9358 | 0.7256 | 0.8418 | 0.9820 | 0.7351 | 0.8413 | 0.9478 |
| Sulfur: ppm | — | | 515 | — | — | 522 | — | — |
| Wt. % | 1.01 | 1.14 | — | 0.34 | 1.67 | — | 0.33 | 1.46 |
| Hydrocarbon Analysis | | | | | | | | |
| Aromatics: Vol. % | — | — | 10.5 | 34.0 | — | 8.5 | 39.0 | — |
| Olefins: Vol. % | — | — | 15.5 | 6.0 | — | 15.5 | 1.5 | — |
| Saturates: Vol. % | — | — | 74.0 | 60.0 | — | 76.0 | 59.5 | — |
| Nitrogen: Wt. % | — | — | <0.005 | 0.036 | — | 0.007 | 0.029 | — |
| Carbon: Wt. % | — | — | 85.28 | 86.66 | — | 85.42 | 86.81 | — |
| Hydrogen: Wt. % | — | — | 14.38 | 13.18 | — | 14.58 | 12.95 | — |
| Cetane No., ASTM D613 | — | — | — | 41.8 | — | — | 45.1 | — |
| Centane Index | — | — | — | 47.2 | — | — | 46.0 | — |
| Viscosity, SUV: Sec. 130° F. (54° C.) | 652[at 100° F. (38° C.)] | — | — | — | 594 | — | — | 121.9 |
| 210° F. (99° C.) | 69 | — | — | — | 80.1 | — | — | 45.7 |
| Nickel: ppm | 3.8 | 5.4 | — | — | 1.0 | — | — | 1.3 |
| Vanadium: ppm | 9.6 | 11.0 | — | — | 1.3 | — | — | 2.3 |
| Pentane Insolubles (Asphaltenes): Wt. % | 2.48 | 3.36 | — | — | 6.49 | — | — | 7.33 |
| Carbon Residue: Rams Wt. % | 4.53 | 5.42 | — | — | 10.20 | — | — | 7.55 |

| | | | EXAMPLE 3 | | | EXAMPLE 4 | | |
|---|---|---|---|---|---|---|---|---|
| | Hydrovisbreaker Feed Oil | | Hydrovisbreaker Product from Empty Reactor, Upflow Operation-785° F. (418° C.) 1,000 psig (70 kg/cm²) and 2.38 hours | | | Hydrovisbreaker Product from Packed Bed, Upflow Operation-795° F. (424° C.) 1,000 psig (70 kg/cm²) and 1.36 hours | | |
| Cut Temperature: ° F. | 350+ (177° C.+) | 650+ (343° C.+) | OP-350 (OP-177° C.) | 350–650 (177–343° C.) | 650+ (343° C.+) | OP-350 (OP-177° C.) | 350–650 (177–343° C.) | 650+ (343° C.+) |
| Volume Percent | 100 | 81.13 | 8.29 | 36.71 | 54.03 | 8.10 | 39.44 | 51.36 |
| Weight Percent | 100 | 82.58 | 6.78 | 34.60 | 57.81 | 6.69 | 37.38 | 54.75 |
| Conversion of 650° F.+ (343° C.+) Feed: Vol. % | — | — | — | — | 33.4 | — | — | 36.7 |
| Liquid Recovery: Wt. % | — | — | — | — | 102.8 | — | — | 100.6 |
| Inspection | | | | | | | | |
| Gravity: ° API | 22.4 | 19.7 | 61.1 | 35.6 | 15.7 | 60.4 | 35.7 | 17.2 |
| Specific Gravity: 60°/60° F.(15.6/15.6° C.) | 0.9194 | 0.9358 | 0.7347 | 0.8468 | 0.9613 | 0.7374 | 0.8463 | 0.9516 |
| Sulfur: ppm | — | | 582 | — | — | 558 | — | — |
| Wt. % 1.01 | 1.14 | — | 0.29 | 1.45 | — | 0.31 | 1.38 | |
| Hydrocarbon Analysis | | | | | | | | |
| Aromatics: Vol. % | — | — | 8.0 | 30.0 | — | 10.5 | 34.0 | — |
| Olefins: Vol. % | — | — | 18.5 | 11.5 | — | 24.5 | 10.0 | — |
| Saturates: Vol. % | — | — | 73.5 | 58.5 | — | 65.0 | 56.0 | — |
| Nitrogen: Wt. % | — | — | 0.006 | 0.032 | — | 0.006 | 0.031 | — |
| Carbon: Wt. % | — | — | 85.39 | 86.38 | — | 85.54 | 86.94 | — |
| Hydrogen: Wt. % | — | — | 14.36 | 13.62 | — | 14.44 | 13.00 | — |
| Cetane No., ASTM D613 | — | — | — | 43.9 | — | — | — | — |
| Centane Index | — | — | — | 48.5 | — | — | 49.5 | — |
| Viscosity, SUV: Sec. 130° F. (54° C.) | 652[at 100° F. 38° C.)] | — | — | — | 262 | — | — | — |
| 210° F. (99° C.) | 69 | — | — | — | 62.4 | — | — | — |
| Nickel: ppm | 3.8 | 5.4 | — | — | 3.3 | — | — | 2.7 |
| Vanadium: ppm | 9.6 | 11.0 | — | — | 5.6 | — | — | 5.1 |
| Pentane Insolubles (Asphaltenes): Wt. % | 2.48 | 3.36 | — | — | 9.15 | — | — | 6.64 |
| Carbon Residue: Rams Wt. % | 4.53 | 5.42 | — | — | 9.59 | — | — | 7.89 |

| | | | EXAMPLE 5 | | | EXAMPLE 6 | | |
|---|---|---|---|---|---|---|---|---|
| | Hydrovisbreaker Feed Oil | | Hydrovisbreaker Product from Packed Bed, Upflow Operation-782° F. (417° C.), 1,000 psig (70 kg/cm²) and 1.38 hours | | | Hydrovisbreaker Product from Packed Bed, Upflow Operation-780° F. (416° C.) 1,000 psig (70 kg/cm²) and 2.74 hours | | |
| Cut Temperature: ° F. | 350+ (177° C.+) | 650+ (343° C.+) | OP-350 (OP-177° C.) | 350–650 (177–343° C.) | 650+ (343° C.+) | OP-350 (OP-177° C.) | 350–650 (177–343° C.) | 650+ (343° C.+) |
| Volume Percent | 100 | 81.13 | 3.05 | 23.84 | 72.06 | 6.40 | 35.45 | 57.34 |
| Weight Percent | 100 | 82.58 | 2.48 | 22.23 | 74.39 | 5.25 | 33.58 | 60.39 |
| Conversion of 650° F.+ (343° C.+) Feed: Vol. % | — | — | — | — | 11.2 | — | — | 29.3 |
| Liquid Recovery: Wt. % | — | — | — | — | 105.6 | — | — | 104.8 |
| Inspection | | | | | | | | |
| Gravity: ° API | 22.4 | 19.7 | 60.2 | 36.0 | 19.8 | 61.1 | 35.3 | 18.5 |
| Specific Gravity: 60°/60° F.(15.6/15.6° C.) | 0.9194 | 0.9358 | 0.7381 | 0.8448 | 0.9352 | 0.7347 | 0.8483 | 0.9433 |
| Sulfur: ppm | — | | 639 | — | — | 555 | — | — |
| Wt. % | 1.01 | 1.14 | — | 0.26 | 1.16 | — | 0.34 | 1.27 |

TABLE 3-continued

VISBREAKING OF HYDRODESULFURIZED RESIDUAL OIL

| | | | | | | | | |
|---|---|---|---|---|---|---|---|---|
| Hydrocarbon Analysis | | | | | | | | |
| Aromatics: Vol. % | — | — | 11.5 | 38.0 | — | 10.0 | 42.5 | — |
| Olefins: Vol. % | — | — | 32.0 | 7.0 | — | 28.0 | 1.0 | — |
| Saturates: Vol. % | — | — | 56.5 | 55.0 | — | 67.0 | 56.5 | — |
| Nitrogen: Wt. % | — | — | 0.004 | 0.030 | — | 0.005 | 0.035 | — |
| Carbon: Wt. % | — | — | 85.80 | 86.43 | — | 85.68 | 86.43 | — |
| Hydrogen: Wt. % | — | — | 14.30 | 13.07 | — | 14.41 | 12.89 | — |
| Cetane No., ASTM D613 | — | — | — | — | — | — | — | — |
| Centane Index | — | — | — | 49.1 | — | — | 50 | — |
| Viscosity, SUV: Sec. | | | | | | | | |
| 130° F. (54° C.) | 652[at 100° F. (38° C.)] | — | — | — | — | — | — | — |
| 210° F. (99° C.) | 69 | — | — | — | — | — | — | — |
| Nickel: ppm | 3.8 | 5.4 | — | — | 3.6 | — | — | 7.2 |
| Vanadium: ppm | 9.6 | 11.0 | — | — | 6.8 | — | — | 10.0 |
| Pentane Insolubles (Asphaltenes): Wt. % | 2.48 | 3.36 | — | — | 3.57 | — | — | 6.60 |
| Carbon Residue: Rams Wt. % | 4.53 | 5.42 | — | — | 5.83 | — | — | 7.20 |

EXAMPLE 1

The results of this test are presented in Table 2 as well as Table 3. This test was performed by passing feed oil and hydrogen upflow through a bed packed with alundum balls at a pressure of 1,000 psig (70 kg/cm²), a temperature of 799° F. (426° C.), a hydrogen flow rate of 2,156 SCF per barrel (38.8 SCM/100L) and a residence time of 2.31 hours. In all tests involving packed reactors, residence time is corrected for the reactor volume occupied by solids.

The test results presented in Table 3 show that there was a relatively small increase in asphaltene constant between the 650° F.+ (343° C.+) fraction of the feed oil and the hydrovisbreaker 650° F.+ (343° C.+) residue, indicating that the visbreaker residue is compatible for blending with the residue feed oil, i.e. it is miscible with the residue feed oil from which it is derived. The residue exhibited the highest stability against precipitate formation (rating of 1) in ASTM test 1661, further indicatng its high quality as a blending stock. Since the hydrovisbreaker residue has an elevated sulfur content, it is advantageous to blend the hydrovisbreaker residue with a residual oil of lower sulfur content than itself and therefore its compatibility with lower sulfur oils is an important feature of the present process. Furthermore, the data show that most of the cracked product comprises saturates, indicating that the cracked product is a stable material.

EXAMPLE 2

The results of this test are presented in Table 2 as well as Table 3. This test was performed by passing feed oil and hydrogen upflow through an empty reactor at a pressure of 1,000 psig (70 kg/cm²), a temperature of 795° F. (424° C.), a hydrogen flow rate of 2,774 SCF per barrel (49.9 SCM/100L) and a residence time of 2.41 hours.

Although in the test of Example 1, which used a packed bed, there was very little coke formation observed at end of run, in this test wherein no packing was employed, the reactor was heavily laden with coke at EOR. The liquid recovery of only 97.6 weight percent in this test indicates a high loss to coke when operating without packing. In contrast, Example 1, which utilized a packing, had A liquid recovery of 100.1 weight percent, indicating little coke formation and reflecting a slight liquid weight gain probably due to addition of hydrogen to the oil.

It is noted that the asphaltene content of the residue product of this test is disadvantageously higher than the asphaltene content of the packed bed product of Example 1 (even at a lower residue conversion), indicating that the hydrovisbreaker residue from an unpacked bed is more aromatic than the residue from the packed bed of Example 1 and is therefore less compatible for blending with the feed oil. However, the residue exhibited the highest stability against precipitate formation (rating of 1) in ASTM test 1661.

EXAMPLE 3

This test was also performed by passing feed oil and hydrogen upflow through an empty reactor, but at milder conditions than the upflow empty reactor test of Example 2. The conditions of this test included a pressure of 1,000 psig (70 kg/cm²), a temperatue of 785° F. (418° C.), a hydrogen flow rate of 2,597 SCF per barrel (46.7 SCM/100L) and a residence time of 2.38 hours.

It is noted that the mild conditions of this test avoided coke formation as indicated by a liquid recovery of 102.8 weight percent but disadvantageously reduced middle distillate yield and residue conversion to significantly lower levels. It is particularly significant that the residue asphaltene level is much higher than in the residue product of the earlier examples. This result is unexpected since a major portion of the middle distillate is believed to be formed by dealkylation of high boiling aromatics which could icrease the aromaticity of these compounds and make them pentane-insoluble and therefore it would be expected that the reduced middle distillate yield in this example would reduce such increase in aromaticity.

EXAMPLE 4

This test was performed by passing hydrodesulfurized feed oil and hydrogen upflow through a packed reactor under relatively mild conditions including a pressure of 1,000 psig (70 kg/cm²), a temperature of 795° F. (424° C.), a hydrogen rate of 3,106 SCF per barrel (55.9 SCM/100L) and a residence time of 1.36 hours.

The results of this test show that at the relatively mild residence time condition employed, residue conversion and middle distillate yield were depressed. However, the results do show that use of a packed bed results in a higher middle distillate to naphtha ratio than was achieved in Examples 2 and 3 when an unpacked bed is utilized.

EXAMPLE 5

This example presents the results of a test performed under even milder conditions, utilizing a packed bed and upflow operation. The test conditions included a pressure of 1,000 psig (70 kg/cm$^2$), a temperature of 782° F. (417° C.), a hydrogen flow of 3,046 SCF per barrel (54.8 SCM/100L) and a residence time of 1.38 hours.

The residue conversion of 11.2 volume percent obtained at the 782° F. (417° C.) temperature and 1.38 hour residence time of this test is low, and therefore the hydrovisbreaking process of the present invention is preferably performed at a temperature of at least 790° or 795° F. (421° or 424° C.), or at a longer residence time.

Since residue hydrodesulfurization processes are generally operated with incremental temperature increases to compensate for catalyst aging and are generally terminated when catalyst deactivation necessitates an elevation of temperature to about 790° F. (421° C.), the hydrovisbreaking process of this invention will preferably operate at temperatures above the end-of-run temperature of the prior hydrodesulfurization step. At hydrovisbreaker temperatures thermally induced hydrocracking reactions supercede and render nugatory the catalytically-motivated hydrodesulfurization reactions. When visbreaking a non-hydrodesulfurized oil or when visbreaking an oil from a hydrodesulfurization process wherein hydrocracking reactions become significant at a lower temperature, such as 750° F. (399° C.), hydrovisbreaker operation can occur at temperatures above 750° F. (399° C.).

EXAMPLE 6

This test was conducted at a low temperature but with a longer residence time to determine whether a longer residence time could compensate for the observed low conversion at low temperature. This test was conducted at a pressure of 1,000 psig (70 kg/cm$^2$), a temperature of 780° F. (416° C.), a hydrogen flow of 3,202 SCF per barrel (57.6 SCM/100L), and a residence time of 2.74 hours. The feed oil and hydrogen were passed upflow through a packed bed.

Table 3 shows that an elongated residence time partially compensates for the low conversion exhibited in Example 5 at low temperature conditions.

An important observation from the data of the above examples is that the utilization of a packed reactor not only increases conversion to middle distillate, but also the asphaltene content of the remaining residue is lower when a packed bed is employed as compared to the use of an empty reaction zone. As noted above, this occurrence is both unexpected and highly advantageous. It is unexpected because middle distillate and naphtha production is believed to be mainly derived from paraffinic alkyl groups on the aromatic residual molecular structures. That the middle distillate and naphtha produced in the above tests is primarily paraffinic in nature is confirmed by the hydrocarbon analysis of naphtha and middle distillate product in the results of Examples 1 through 6 shown in Table 3 in which it is shown that these product fractions contain more saturates than aromatics and olefins combined.

Since the middle distillate and naphtha products of visbreaking are primarily saturated materials, it would be expected that the increased yield of these materials via use of a packed reactor would leave a residue of enhanced aromaticity, i.e. of enhanced asphaltenic content, since asphaltenes are characterized by high aromaticity as indicated by the fact that asphaltenes comprise the only oil fraction which is insoluble in normal pentane. Unexpectedly, the data presented in Table 3 show that the very reverse occurs, i.e. an increased production of primarily saturated naphtha and middle distillate product by use of a packed bed reactor unexpectedly leaves a residue which is advantageously less asphaltenic than the product of a non-packed reactor visbreaking operation wherein less naphtha and middle distillate is produced. Table 3 shows that all of the packed bed tests yielded a 650° F.+ (343° C.+) cracked residue having less than 7 weight percent of pentane insolubles, whereas both of the upflow empty reactor tests yielded a 650° F.+ (343° C.+) cracked residue having more than 7 weight percent of pentane insolubles.

The recovery of a visbreaking residue having a relatively low asphaltenic content is advantageous for purposes of blending the residue fraction. The hydrovisbreaker residue has a greater sulfur content than the visbreaker feed oil and requires blending with either an external stream of hydrodesulfurizer feed oil in order to undergo further desulfurization or with an external stream of low sulfur hydrodesulfurizer effluent to form a blended oil of intermediate sulfur level. If the hydrodesulfurizer residue has an excessively high asphaltene level the low hydrogen to carbon ratio of its components could render it incompatible for blending with an external residue or distillate stream whose components have a much higher hydrogen to carbon ratio. Furthermore, a high asphaltene level would render the visbreaker residue more difficult to further desulfurize because it is known that dealkylated asphaltenes tend towards very high coking levels during hydrodesulfurization as compared to non-dealkylated asphaltenes.

Figure 2:
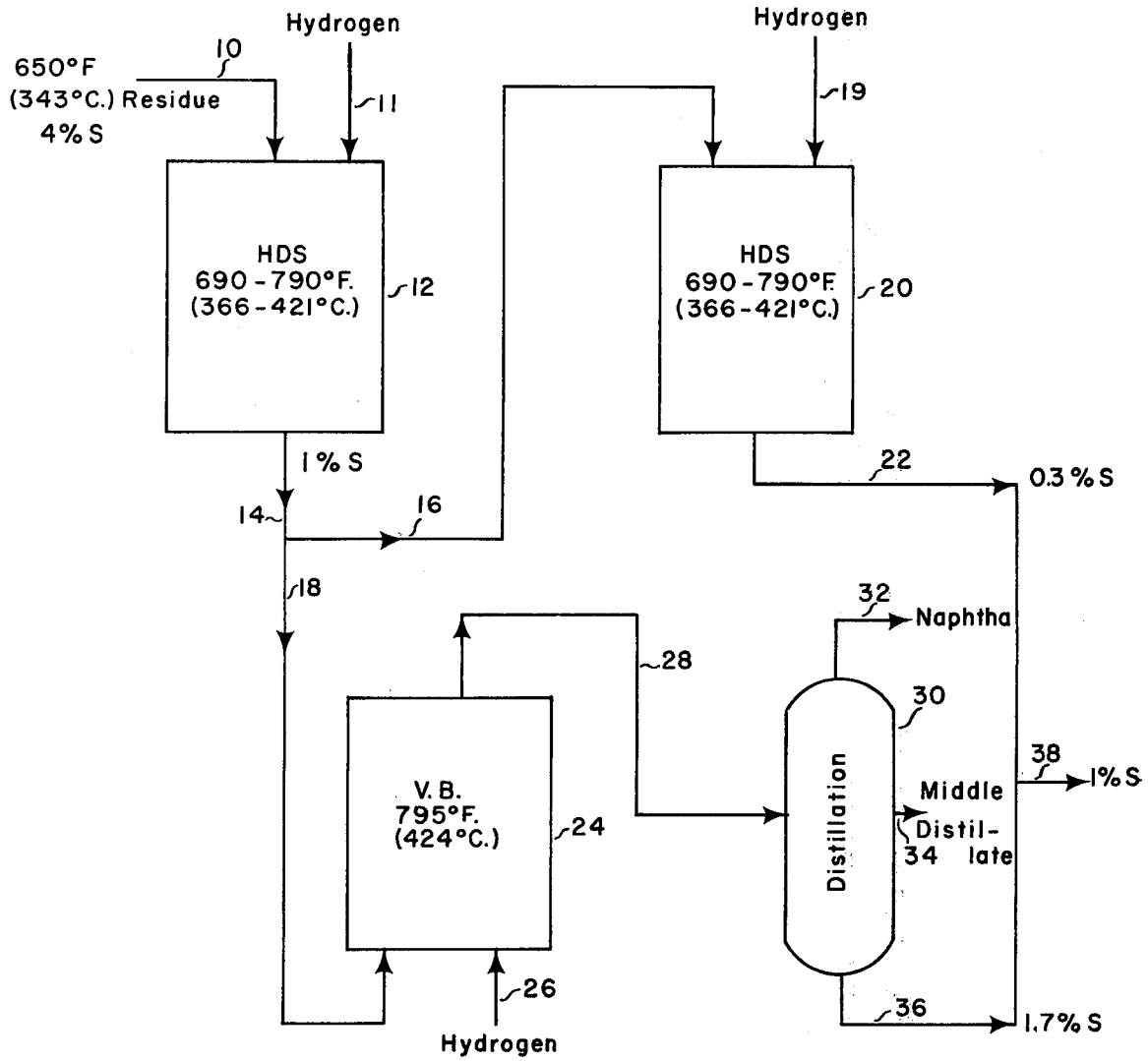

Yield data taken from the above examples are summarized graphically in FIG. 1 and a process flow scheme of this invention is shown in FIG. 2.

Referring to FIG. 1, the two solid lines relate residue conversion (i.e. conversion of the 650° F.+ (343° C.+) material in the hydrodesulfurized feed oil) to total product middle distillate (including middle distillate in the hydrodesulfurized feed oil) and to middle distillate to naphtha ratio, respectively, when the packed reactor upflow method of this invention is utilized. The two dashed lines in FIG. 1 show the corresponding results when employing upflow operation with an empty reactor. It is seen from FIG. 1 that the empty reactor tests resulted in less product middle distillate and in a reduced middle distillate to naphtha ratio, i.e. a reduced selectivity to middle distillate. Therefore, FIG. 1 shows that the empty reactor exhibited on a proportional basis a higher degree of overcracking of middle distillate to naphtha. As indicated above, a reduced middle distillate to naphtha ratio is disadvantageous in hydrovisbreaking because naphtha can be produced without hydrogen consumption and with a higher octane value in an FCC process without added hydrogen than in a hydrovisbreaker.

EXAMPLE 7

All the above examples present tests performed in upflow operation. For purposes of comparison, tests were performed utilizing downflow operation employing various types of fixed or packed beds of stationary solids, including fixed or stationary catalytic beds. These tests are tabulated in Table 4.

TABLE 4

DOWNFLOW HYDROVISBREAKING TESTS

| Test | Solid | Conditions | Residual Conversion | $C_5$–350° F. ($C_5$–177° C.) | 350–650° F. (177–343° C.) | 650° F.+ (343° C.+) | Material Balance Weight Percent |
|---|---|---|---|---|---|---|---|
| | | Hydrodesulfurized Residual Feed Oil to Visbreaker | Product Yields (Weight % of Liquids) | | | | |
| 1 | Fresh 1/8 inch (0.32 cm) diameter NiCoMo on Alumina HDS Catalyst | 851° F. (455° C.) 1,000 psi (70 kg/cm²) 0.5 LHSV | 52.05 | 20.5 | 40.6 | 38.9 | 92 |
| 2 | Fresh 1/32 inch (0.08 cm) diameter NiCoMo on Alumina HDS Catalyst | 826° F. (441° C.) 1,000 psi (70 kg/cm²) 0.5 LHSV | 32.33 | 6.2 | 38.9 | 54.9 | 93 |
| 3 | Same as Test 2 | 850° F. (454° C.) 1,000 psi (70 kg/cm²) 0.5 LHSV | 46.13 | 4.9 | 51.4 | 43.7 | — |
| 4 | Sintered Catalyst of Test 1 | 824° F. (440° C.) 1,000 psi (70 kg/cm²) 1 LHSV | 23.94 | 8.5 | 29.8 | 61.7 | 97 |
| 5 | Ceramic Beads | 853° F. (456° C.) 1,000 psi (70 kg/cm²) 0.5 LHSV | 20.25 | 3.9 | 31.4 | 64.7 | 95 |
| 6 | Alundum Balls | 864° F. (462° C.) 1,000 psi (70 kg/cm²) 0.5 LHSV | 16.55 | 4.9 | 27.4 | 67.7 | 95.3 |
| 7 | Spent NiCoMo on Alumina HDS Catalyst | 824° F. (440° C.) 1,000 psi (70 kg/cm²) 0.5 LHSV | 10.14 | 4.9 | 22.2 | 72.9 | 96 |
| | | Non-Hydrodesulfurized Residual Feed Oil to Visbreaker | | | | | |
| 8 | Same as Test 2 | 826° F. (441° C.) 1,000 psi (70 kg/cm²) 0.5 LHSV | 33.32 | 7.4 | 38.5 | 54.1 | 92 |

Tests 1 through 7 of Table 4 present the results of tests utilizing a portion of the hydrodesulfurized residual oil described in Table 2 together with hydrogen in downflow operation. Table 4 indicates for each test the packing material and the conditions employed.

Tests 5, 6 and 7 of Table 4 were performed utilizing various catalytically inert solid packing materials. Test 5 employed ceramic beads, Test 6 employed alundum balls and Test 7 employed a completely deactivated NiCoMo on alumina residual oil hydrodesulfurization catalyst. In these tests the middle distillate yield was considerably lower than was obtained in upflow tests reported above performed under even milder temperature conditions.

Tests 1, 2, 3 and 4 of Table 4 were performed utilizing either fresh or partially deactivated NiCoMo on alumina residual oil desulfurization catalysts as a packing material in downflow operation; fresh catalyst being employed in Tests 1, 2 and 3 and a partially deactivated sintered catalyst being employed in Test 4. Test 2 shows that use of an active residual oil hydrogenation catalyst at a visbreaking temperature which is considerably above the upper temperature limit for hydrodesulfurization, which is 790° F. (421° C.), produced nearly the same residue conversion, middle distillate yield and naphtha yield as was obtained in Example 4 above when utilizing an inert solid in upflow operation at a considerably lower temperature. This shows that upflow operation is so superior to downflow operation that equivalent results are obtained in upflow operation even though a catalytically inert, non-porous solid packing is employed in upflow operation, as compared to use of a highly porous hydrogenation catalyst in downflow operation. It is of considerable economic significance that the same product yield can be achieved in upflow operation at a lower temperature because hydrogen consumption increases as reaction temperature increases, so that the low temperature upflow hydrovisbreaker operations of this invention result in a hydrogen savings at a given yield. Test 7 when compared with Example 5 shows that obtaining the same middle distillate yield with a partially deactivated catalyst in downflow operation requires a 42° F. (23° C.) higher temperature than when employing an inert solid in upflow operation.

A comparison of Tests 1 and 2 illustrates the lack of effectiveness of hydrogenation catalytic activity in the present hydrovisbreaking process. As stated above, the conversion and yields achieved with the active catalyst of Test 2 are substantially the same as the conversion and yields obtained with an inert non-porous solid, in upflow operation at a much lower temperature, as shown in Example 4. As indicated above, the process which can achieve the given yield at a lower temperature is superior, since hydrogen consumption is reduced as temperatures are reduced. A comparison of Tests 1 and 2, both performed with fresh commercial NiCoMo on alumina residual oil hydrodesulfurization catalysts, show that increasing the temperature from the temperature of Test 2 to the higher temperature of Test 1 did not result in a significant increase in the yield of the desired middle distillate product, but disadvantageously greatly increased the naptha product. Therefore, an attempt toward greater yields with an active hydrotreating catalyst in downflow operation under visbreaking conditions is futile since it only tends towards undesired aftercracking without increasing the yield of the desired middle distillate product. Therefore, the employment of a catalyst in downflow operations is unable to improve upon either the middle distillate yield or middle distillate to naphtha ratio presented in Example 4 obtained when employing an inert solid and upflow operation.

Table 4 indicates a further disadvantage in the use of an active catalyst for the present hydrovisbreaking process. Tests 1 and 2, which employed active catalysts obtained a $C_5$+ yield of only 92 and 93 weight percent, respectively, whereas Tests 4 to 7 which used an inert solid or an inactive or partially active catalyst obtained $C_5$+ yields of 95 to 97 weight percent. It is interesting that the highest $C_5$+ yields were obtained with the sintered and spent catalysts of Tests 4 and 7.

The results of Tests 1, 2, 3 and 4 in Table 4 show that under the elevated temperature conditions of visbreaking, the thermal effect upon the reaction supersedes any potential catalytic effect. Table 4 shows that the potential catalytic effectiveness of a fresh or partially deactivated residual oil hydrodesulfurization catalyst cannot be realized in a downflow visbreaking operation, since these catalysts require temperatures below the hydrovisbreaking range to exert their effectiveness. Instead, at visbreaking temperatures these catalysts tend to function only as an inert solid contacting agent. Therefore, when a residual oil hydrodesulfurization catalyst is completely and permanently deactivated in a conventional downflow residual oil desulfurization process by deposit of coke and substantial saturation with metals from feed oil as indicated by a reaction temperature which has been gradually increased to a cycle termination temperature of about 790° F. (421° C.) to compensate for loss of catalyst activity, the reactor can thereupon be advantageously utilized as a hydrovisbreaker by reversing oil flow and charging to the same reactor either a non-desulfurized oil with or without hydrogen or a hydrodesulfurized oil from a parallel hydrodesulfurization reactor together with hydrogen in an upflow path at a temperature above 790° F. (421° C.). The visbreaking reaction advantageously requires a lower pressure than is commonly required in a hydrodesulfurization process, whereby the hydrodesulfurization reactor will be able to metallurgically withstand the elevated hydrovisbreaking temperatures when it is converted into a visbreaking reactor. Advantageously, the flow reversal will enable the hydrovisbraking operation to take advantage of the porosity profile of the substantially deactivated hydrodesulfurization catalyst wherein most pore plugging has been experienced at the top of the catalyst bed and wherein any unplugged pores reside at the bottom of the bed. By charging the visbreaker feed to the bottom of the bed, any remaining catalyst porosity at the bottom of the bed can be utilized to provide a product residue which is highly stable against precipitate formation, with the lack of porosity at the top of the bed tending to retard undesired aftercracking of middle distillate to naphtha. The use of a deactivated catalyst for visbreaking produced visbreaker residues which visually appeared to be more stable than the stable residues obtained from the non-catalytic solids.

Use of the porosity profile of a deactivated HDS catalyst in hydrovisbreaking does not indicate a catalytic action in the visbreaking process. Instead, what is utilized is the considerable internal surface area within the catalyst pores for improved oil and hydrogen contact and for improved mixing of oil and hydrogen. At the top of the bed these pores are likely to be plugged, while at the bottom of the bed they are more likely to be at least partially open and of use as an oil-hydrogen contact surface and as a means of inducing intimate mixing of oil and hydrogen. The consideration of pores does not apply to a packing of inert solid contact material that is not derived from a catalytic entity, since inert contact materials are non-porous. An indication of the value of partially or completely deactivated hydrogenation catalysts in hydrovisbreaking is seen in Tests 4 and 7 of Table 4, which indicate that use of these catalysts result in a higher $C_5$+ yield than either active catalysts or inert solids.

Test 8 shows the results of a test performed under the same conditions as Test 2, except that a non-desulfurized feed was employed. Comparing Test 8 with Test 2, it is seen that nearly identical yields were obtained when employing the desulfurized and non-desulfurized residues as feed oils to the hydrovisbreaker.

Since the hydrovisbreaker residue has an elevated sulfur content as compared to the hydrovisbreaker feed oil, it is necessary to have a source of relatively low sulfur residual oil with which it is compatible for blending purposes in order to ultimately recover a blended residue of intermediate sulfur value. Therefore, it is an important feature of the present invention that the upflow hydrovisbreaker residue is particularly suitable for blending. The data presented above show that the upflow packed bed method of visbreaking produces an effluent of relatively low asphaltene content, indicating that the visbroken oil does not have an excessive aromaticity and is therefore a compatible blending oil for other residues. It is shown above that the use of the upflow packed visbreaker bed of this invention surprisingly produces a product residue having a lower asphaltene content (lower aromaticity) than an upflow non-packed bed, as well as producing a higher yield of middle distillates than a non-packed bed. Therefore, splitting a first stage hydrodesulfurizer residual oil effluent into an upflow packed bed visbreaker feed oil and a second stage catalytic hydrodesulfurizer feed oil, as shown in FIG. 2, permits production of a relatively high yield of visbroken middle distillate as well as a hydrovisbreaker residue which is sufficiently low in asphaltenes to be compatible for blending with the low sulfur second stage hydrodesulfurizer effluent.

A process for performing this embodiment is illustrated in FIG. 2. Referring to FIG. 2, a 650° F.+ (343° C.+) petroleum residual oil containing metals and having about 4 weight percent sulfur entering through line 10 and hydrogen entering through line 11 are passed downflow through an initial hydrodesulfurization zone 12 containing a nickel-cobalt-molybdenum on alumina hydrodesulfurization catalyst at a temperature which is increased incrementally to compensate for catalyst aging within the temperature range of about 690° to about 790° F. (366 to 421° C.) and at a hydrogen pressure of at least 1,500 psi (105 kg/cm²). The effluent from reactor 12 in line 14, with or without a flashing step, not shown, to remove 650° F.− (343° C.−) material, has about 1 weight percent sulfur and is split between a first portion in line 16 and a second portion in line 18. The stream in line 16 passes downwardly through a second hydrodesulfurization zone 20 together with recycle and/or makeup hydrogen entering through line 19 operating with a similar or different catalyst and under similar or different conditions of temperature and pressure as reactor 12. A second stage hydrodesulfurizer effluent is discharged through line 22 and contains about 0.3 weight percent sulfur. Second hydrodesulfurization zone 20 can signify more than one zone, such as an intermediate and a final hydrodesulfurization zone, with or without interstage flashing steps between zones for interstage removal of distillate from residual oil.

The second portion of the first hydrodesulfurization stage effluent in line 18 is passed upwardly through a hydrovisbreaker zone 24 packed with an inert solid together with hydrogen entering through line 26 at a temperature of 795° F.+ (424° C.+) and at a hydrogen pressure of about 1,000 psi (70 kg/cm$^2$) wherein it is partially converted to naphtha and middle distillate and from which it is discharged through line 28 for passage to a distillation zone 30.

In distillation zone 30, naphtha is discharged overhead through line 32, middle distillate is removed through line 34 and 650° F.+ (343° C.+) residue containing about 1.7 weight percent sulfur and less than 7 weight percent asphaltenes is removed through line 36. The volume of this residue is relatively small as compared to the volume of the residue in line 22 because of its depletion via production of a substantial yield of naphtha and middle distillate. Also, the residue in line 36 has experienced only a moderate increase in asphaltene level relative to the asphaltene level of the stream in line 22 by virtue of the upflow, packed bed hydrovisbreaking procedure, whereby it is compatible for blending with the stream in line 22. At least a portion of the relatively small volume stream in line 36 is blended with at least a portion of the relatively larger volume stream line 22 to produce a blended stream in line 38 having 1 weight percent sulfur, or less. In this manner, second stage hydrodesulfurizer 20 cooperates with visbreaker 24 to provide an asphaltene-containing stream of residual oil having a reduced sulfur level for blending with the visbreaker effluent in order to moderate the increased sulfur level of the visbreaker residue. The upflow, packed bed procedure for visbreaking on its part cooperates with hydrodesulfurizer 20 to produce a compatible residue for blending by producing a residue having only a moderately elevated asphaltene level.

I claim:

1. A process comprising passing an asphaltene-containing residual oil containing metals and sulfur together with hydrogen downflow through initial and final catalytic hydrodesulfurization zones in series to produce a relatively low sulfur hydrodesulfurized effluent, passing a portion of the hydrodesulfurized oil flowing between said hydrodesulfurization zones through a thermal cracking zone containing a fixed bed of inert solids at a temperature from 750° to 1,000° F. which is above the hydrodesulfurization temperature to produce thermally cracked light oil and thermally cracked relatively high sulfur heavy oil containing less than 7 weight percent pentane insolubles, separating thermally cracked light oil from said relatively high sulfur cracked heavy oil, and blending at least a portion of said relatively high sulfur thermally cracked heavy oil with at least a portion of said relatively low sulfur hyrodesulfurization effluent.

2. The process of claim 1 wherein the oil flows upwardly through said thermal cracking zone.

3. The process of claim 1, including a flashing step between said hydrodesulfurization zones.

4. The process of claim 1 wherein the pressure in said thermal cracking zone is lower than the pressure in said hydrodesulfurization zones.

5. The process of claim 1 wherein the hydrodesulfurization catalyst comprises Group VI and Group VIII metals on a non-cracking support.

6. The process of claim 1 wherein said inert solids comprises deactivated hydrodesulfurization catalyst.

7. The process of claim 1 wherein the temperature in each of said hydrodesulfurization zones is increased incrementally to compensate for loss of catalyst activity with age.

8. The process of claim 1 wherein the temperature in the thermal cracking zone is above 790° F.

9. The process of claim 1 wherein hydrogen is passed through said thermal cracking zone.

* * * * *

UNITED STATES PATENT AND TRADEMARK OFFICE

CERTIFICATE OF CORRECTION

PATENT NO. : 4,005,006

DATED : January 25, 1977

INVENTOR(S) : Angelo A. Montagna

It is certified that error appears in the above-identified patent and that said Letters Patent are hereby corrected as shown below:

COL. 7, Table 3, under "Example 3" "Wt. %1.01"... should read --Wt. % 1.01--...

COL. 10, Table 3, sixth column, "67.0" should read --62.0--

COL. 10, Table 3, fifth column, "3.57" should read --5.57--

Signed and Sealed this

*twenty-sixth* Day of *July 1977*

[SEAL]

*Attest:*

RUTH C. MASON
*Attesting Officer*

C. MARSHALL DANN
*Commissioner of Patents and Trademarks*